United States Patent [19]

Allen, Jr.

[11] 4,432,546

[45] Feb. 21, 1984

[54] FINGER INSERT FOR BOWLING BALLS

[76] Inventor: Bernard D. Allen, Jr., 4108 N. Belmont, Kansas City, Mo. 64117

[21] Appl. No.: 419,716

[22] Filed: Sep. 20, 1982

[51] Int. Cl.[3] ..... A63B 37/00; A63B 43/02

[52] U.S. Cl. ..... 273/63 A

[58] Field of Search ..... 273/63 A, 63 B, 63 R, 273/64, 63 C, 63 D; 33/174 F

[56] References Cited

U.S. PATENT DOCUMENTS

| | | | |
|---|---|---|---|
| 1,021,490 | 3/1912 | Scully | 273/63 A |
| 2,469,268 | 5/1949 | Jerome | 273/63 A |
| 2,472,406 | 6/1949 | Darula | 273/63 A |
| 2,482,190 | 9/1949 | Kramer | 273/63 A |
| 2,708,578 | 5/1955 | Mitchell | 273/63 |
| 3,012,783 | 12/1961 | Bunk | 273/63 |
| 3,129,002 | 4/1964 | Bednash | 273/63 |
| 3,148,881 | 9/1964 | Yettito | 273/63 |
| 3,271,031 | 9/1966 | Mitchell | 273/63 A |
| 3,316,588 | 5/1967 | Vezirakis | 18/5.1 |
| 3,342,488 | 9/1967 | Novatnak | 273/63 |
| 3,416,796 | 12/1968 | Ginder | 273/63 |
| 3,454,440 | 7/1969 | Vezirakis | 156/242 |
| 3,784,198 | 1/1974 | Bach | 273/63 |
| 3,804,412 | 4/1974 | Chetirko | 273/63 A |
| 3,816,681 | 1/1975 | Kelsey | 273/63 B |
| 3,963,238 | 6/1976 | Patrignani | 273/63 A |
| 4,062,540 | 12/1977 | Calentine | 273/54 B |
| 4,358,112 | 11/1982 | Straborny | 273/63 A |

*Primary Examiner*—George J. Marlo

*Attorney, Agent, or Firm*—Kokjer, Kircher, Bradley, Wharton, Bowman & Johnson

[57] ABSTRACT

An insert for the finger holes of a bowling ball. The insert has a hollow body which is held by partial vacuum in the finger hole. A finger pad on the insert is contacted by the finger tip to provide cushioning. A high friction corrugated surface on the finger pad enhances the grip of the finger tip. The finger opening varies in size among different inserts to accommodate various sized fingers, although the thickness of the finger pad remains constant to maintain the cushioning effect uniform and to facilitate drilling of the finger holes to the proper span in the ball. All inserts have the same outside diameter to standardize the size of the finger holes in the bowling balls.

3 Claims, 5 Drawing Figures

Fig. 1.
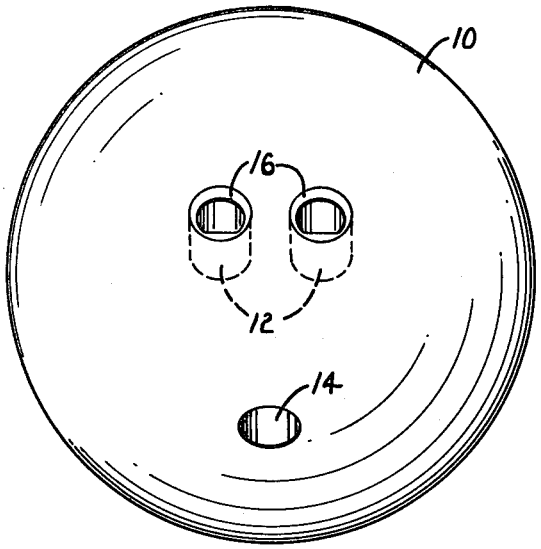
Fig. 2.
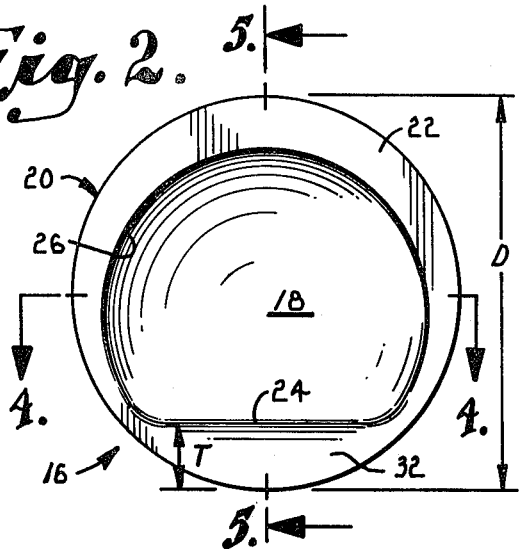
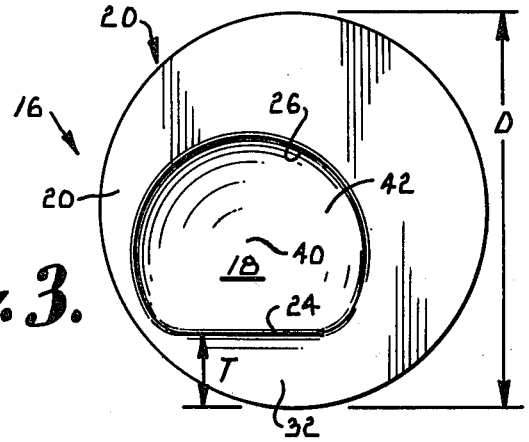
Fig. 3.
Fig. 4.
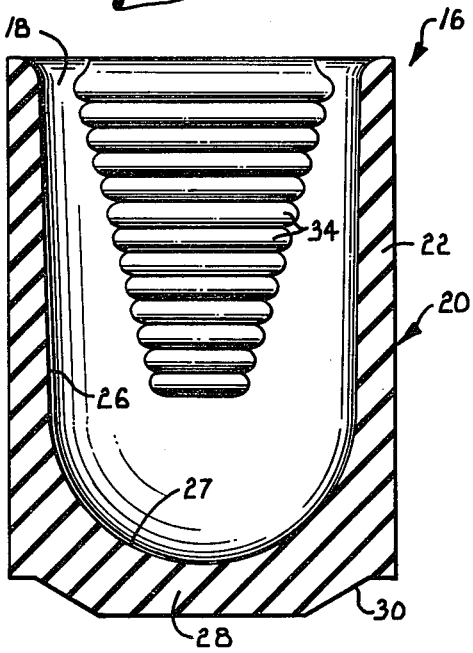
Fig. 5.
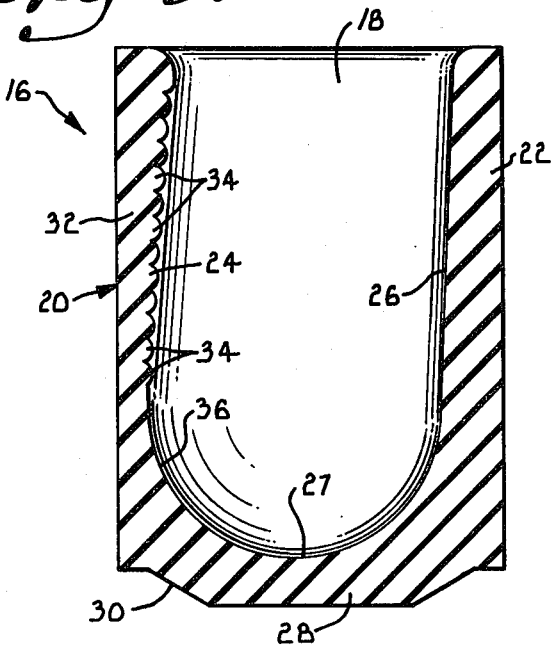

FINGER INSERT FOR BOWLING BALLS

BACKGROUND AND SUMMARY OF THE INVENTION

This invention relates generally to inserts for the finger holes of bowling balls and deals more particularly with inserts that act to improve the grip of the finger tip as well as to cushion it.

A prior art publication discloses a bowling ball insert which serves primarily to cushion the finger tip and does not enhance the grip to any appreciable extent. The surface of the insert which is gripped by the finger tip is a smooth surface which at most improves the grip only insignificantly. Also, the outside diameter of the finger insert can vary from unit to unit, and each insert can be used only in a finger hole that has been drilled to the particular size that will accommodate the insert. Thus, the drill holes in the bowling balls cannot be standardized in size. Another problem is that the wall thickness can vary depending on the size of the finger hole opening. When the wall contacted by the finger tip varies in thickness, the cushioning effect and "feel" vary from one insert to another, and there is a lack of uniformity in these respects. Variation in the thickness of the finger pad also makes it difficult to properly drill the finger holes to the proper span in the bowling ball, since the span or distance of the finger holes from the thumb hole is difficult to ascertain.

The present invention is directed to an improved bowling ball insert and has, as its principal goal, the provision of a finger insert which eliminates the foregoing problems. In accordance with the invention, a finger insert is held by partial vacuum in the finger hole of a bowling ball. A high friction corrugated surface on the finger pad area of the insert improves the grip of the finger tip and minimizes slipping of the bowling ball during delivery. The internal opening which receives the finger comes in a range of sizes so that the proper insert can be selected for each particular finger size. However, the outside diameter of each insert is the same regardless of the finger size so that all of the inserts fit interchangeably in standard size finger holes. This permits the finger holes of all bowling balls to be drilled to a uniform diameter. The thickness of the finger pad is the same for all of the inserts regardless of size, and uniformity is thus achieved in the cushioning effect provided by the inserts. Also, drilling of the finger holes in the bowling ball is facilitated because the span between the finger holes and thumb hole can be easily determined by subtracting the known and constant finger pad thickness from the measured span dimension. The finger openings for the smaller inserts are offset to one side in order maintain the strength of the bowling ball bridge. Due to the offset, the finger holes of smaller inserts do not have to be spread apart farther than those of larger inserts associated with larger hands.

DETAILED DESCRIPTION OF THE INVENTION

In the accompanying drawing which forms a part of the specification and is to be read in conjunction therewith and in which like reference numerals are used to indicate like parts in the various views:

FIG. 1 is a plan view of a bowling ball provided with a pair of finger inserts constructed according to a preferred embodiment of the present invention;

FIG. 2 is a top plan view on an enlarged scale showing a finger insert constructed to accommodate a relatively large finger;

FIG. 3 is a plan view similar to FIG. 2, but showing a finger insert constructed to accommodate a relatively small finger;

FIG. 4 is a sectional view taken generally along line 4—4 of FIG. 2 in the direction of the arrows; and FIG. 5 is a sectional view taken generally along line 5—5 of FIG. 2 in the direction of the arrows.

Referring now to the drawing in more detail and initially to FIG. 1, numeral 10 designates a conventional bowling ball having the usual pair of side by side finger holes 12 and a thumb hole 14. In accordance with the present invention, a finger insert 16 is installed in each finger hole 12 in order to cushion the finger tips and improve their grip.

FIG. 2 illustrates an insert 16 having a finger opening 18 of maximum size. Each insert has a resilent body 20 which is generally cylindrical in shape and which has a diameter D to fit closely in the finger hole 12 of the bowling ball. The body 20 can be molded from a soft vinyl material or another suitable material. The finger opening 18 extends into one end of the resilient body 20 and is surrounded by a wall 22 having a generally cylindrical configuration. On one side of the finger opening 18, wall 22 presents a generally planar surface 24. The remainder of the wall surface which faces into opening 18 is cylindrical as indicated at 26. The bottom of the finger opening 18 is hemispherical, as indicated at 27. The shape of finger opening 18 is thus generally cylindrical, with a hemisphere 27 on the bottom and with part of the cylinder beveled out to form surface 24.

Referring now to FIGS. 4 and 5 in particular, the body 20 has a solid bottom 28 which closes the bottom of the finger opening 18. The bottom 28 is generally circular and has a stepped surface 30 extending around its periphery where it connects with the exterior surface of wall 22.

The planar surface 24 is formed on a finger pad 32 which is defined on one segment of the wall 22. The finger pad 32 cushions the finger tip which contacts it during use. As particularly shown in FIGS. 4 and 5, the planar surface 24 is a textural high friction surface which is provided with a series of corrugations 34. The corrugations 34 extend horizontally across the high friction surface 24 and begin at the top thereof. The corrugations terminate above the bottom 28 of the insert. Between the lowest corrugation 34 and the bottom 28 of body 20, a concave surface 36 is formed at a location to receive the curved end portion of the finger tip. As best shown in FIG. 4, the corrugations 34 gradually decrease in length from top to bottom such that the lower corrugations are considerably shorter than the upper corrugations. The thickness of the finger pad 32 gradually decreases from the upper corrugations to the lower corrugations.

It is contemplated that the finger inserts 16 will be provided with various finger opening sizes. Preferably, the range of finger opening sizes vary between $\frac{1}{2}$ inch and 29/32 inch as defined by the diameter of the arcuate surface 26. FIG. 2 illustrates the largest finger opening, while FIG. 3 illustrates the smallest finger opening. It is noted that regardless of the size of the finger opening 18, the finger pad 32 has the same thickness T (preferably in the range of $\frac{1}{8}$ to 3/16 inch). Also, the outside diameter D of each insert is the same (preferably one inch) regardless the size of the finger opening 18. By maintaining the diameter D constant, all of the inserts can fit interchangeably in finger holes 12 that have a diameter of 31/32 inch. Thus, the size of the finger holes 12 can be standardized at 31/32 inch, and all of the finger holes can be drilled to this diameter. Regardless of the size of the finger opening 18, the thickness T of the finger pad 32 is the same so that all of the inserts have the same cushioning effect and the same "feel". Also, maintaining the finger pad thickness T the same for all inserts simplifies drilling of the finger holes in the bowling ball since it simplifies determination of the proper span between the thumb hole and finger holes. The span used when drilling the finger holes should be the measured span minus the known dimension T.

The insert shown in FIG. 3 is identical to that shown in FIG. 2, except that the finger opening 18 is smaller and its geometric center 40 is offset to one side of the center 42 of the body 20. When smaller sized inserts such as that shown in FIG. 3 are used, the centers 40 of two side by side inserts are closer together than in the case where larger inserts are used. Thus, the bridge distance between two side by side inserts is reduced for smaller inserts in order to compensate for the smaller hand without weakening the bridge of the bowling ball.

In use, the inserts 16 are placed in the finger holes 12 of the bowling ball and pressed to the bottom of the holes. Due to the shape of the inserts and their close fit in the drill holes 12, a partial vacuum develops at the base portions of the drill holes, and the partial vacuum holds the inserts securely in place in the drill holes.

During delivery of the bowling ball, the finger tips which are inserted into the finger openings 18 contact the high friction textured surface 24, and the corrugations 34 enhance the grip of the finger tips. As a result, slipping of the bowling ball during delivery is avoided. At the same time, the finger pads 32 cushion the finger tips and permit the bowling ball to be delivered in a smooth fashion.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. An insert for a finger hole in a bowling ball, said insert comprising:

a resilient body adapted to be inserted into the finger hole, said body having a generally cylindrical wall surrounding a finger opening which is sized to receive a finger tip and which extends into said body from an open end thereof;

a solid bottom of said body providing a closed end opposite said open end;

a finger pad forming one portion of said wall for cushioning the finger tip, said finger pad gradually tapering in thickness from said open end toward said closed end and presenting a substantially planar friction surface facing into the finger opening of said body; and a plurality of transverse corrugations on said friction surface to texture same and increase the frictional force and gripping action of the finger tip applied thereto, said corrugations gradually decreasing in length from said open end toward said closed end.

2. A series of inserts for finger holes of bowling balls, comprising:

a plurality of resilient bodies each having a continuous wall defining generally cylindrical shape and each being substantially equal in diameter to the other bodies to enable the bodies to fit interchangeably in different finger holes having a corresponding diameter;

a single finger opening in each body defined within the wall thereof for receiving a finger tip, the finger openings of different bodies being of different lateral dimension to accommodate finger tips of different sizes and each finger opening having a geometric center which is located on the corresponding body at a location laterally offset from the geometric centers of all finger openings having a different lateral dimension; and a finger pad on each body forming one portion of the wall thereof, said finger pads serving to cushion the finger tips and each finger pad being substantially the same thickness as all other finger pads, regardless of the lateral dimension of the corresponding finger opening.

3. The invention of claim 2, including a corrugated friction surface on each finger pad facing into the adjacent finger opening.

* * * * *